US007905100B2

(12) United States Patent
Thybo et al.

(10) Patent No.: US 7,905,100 B2
(45) Date of Patent: Mar. 15, 2011

(54) METHOD FOR CONTROLLING TEMPERATURE IN A REFRIGERATION SYSTEM

(75) Inventors: Claus Thybo, Soenderborg (DK); Ole Ploug, Roedekro (DK)

(73) Assignee: Danfoss A/S, Nordborg (DK)

( * ) Notice: Subject to any disclaimer, the term of this patent is extended or adjusted under 35 U.S.C. 154(b) by 824 days.

(21) Appl. No.: 11/721,859

(22) PCT Filed: Dec. 14, 2005

(86) PCT No.: PCT/DK2005/000791

§ 371 (c)(1), (2), (4) Date: Jul. 20, 2007

(87) PCT Pub. No.: WO2006/063591

PCT Pub. Date: Jun. 22, 2006

(65) Prior Publication Data

US 2009/0210102 A1 Aug. 20, 2009

(30) Foreign Application Priority Data

Dec. 16, 2004 (DK) ..... PA 2004 01949

(51) Int. Cl.

| | |
|---|---|
| ***G01K 13/00*** | (2006.01) |
| ***F25B 49/00*** | (2006.01) |
| ***G05D 23/32*** | (2006.01) |
| ***G08B 17/00*** | (2006.01) |

(52) U.S. Cl. ..... 62/129; 62/127; 62/157; 340/585

(58) Field of Classification Search ..... 62/125, 62/126, 127, 129, 130, 157, 246; 340/584, 340/585, 588

See application file for complete search history.

(56) References Cited

U.S. PATENT DOCUMENTS

| | | | |
|---|---|---|---|
| 3,967,215 | A | 6/1976 | Bellak |
| 4,241,587 | A | 12/1980 | Dienemann et al. |
| 5,621,162 | A | 4/1997 | Yun et al. |
| 5,624,697 | A | 4/1997 | Lin et al. |
| 6,063,420 | A | 5/2000 | Chun et al. |
| 6,739,146 | B1 | 5/2004 | Davis et al. |
| 6,772,597 | B1 | 8/2004 | Zentner et al. |
| 2002/0161545 | A1 | 10/2002 | Starling et al. |

(Continued)

FOREIGN PATENT DOCUMENTS

| | | | |
|---|---|---|---|
| DE | 4210090 | A1 | 11/1992 |

(Continued)

OTHER PUBLICATIONS

International Search Report for PCT/DK2005/000791 dated Jun. 12, 2006.

(Continued)

*Primary Examiner* — Chen-Wen Jiang

(74) *Attorney, Agent, or Firm* — McCormick, Paulding & Huber LLP

(57) ABSTRACT

A method for controlling a temperature in a refrigeration system using a quality decay value expressing an expected decay rate in quality of the products being refrigerated, and which depends on the temperature of air present in the refrigeration system. The quality decay value is obtained using a mathematical model reflecting one or more physical and/or biological processes in the products. Prevents or reduces the quality degradation of the products in terms of shelf life, appearance or tastiness. Furthermore, a method for controlling the temperature in such a way that effects of scheduled events, such as temperature increase during defrosts, can be compensated prior to the event.

11 Claims, 3 Drawing Sheets

U.S. PATENT DOCUMENTS

| | | | | |
|---|---|---|---|---|
| 2002/0189267 | A1 * | 12/2002 | Singh et al. | 62/126 |
| 2003/0224356 | A1 | 12/2003 | Knoll et al. | |
| 2004/0237547 | A1 | 12/2004 | Delpuech et al. | |
| 2005/0166608 | A1 | 8/2005 | Thybo | |
| 2005/0172647 | A1 | 8/2005 | Thybo et al. | |

FOREIGN PATENT DOCUMENTS

| | | | | |
|---|---|---|---|---|
| DE | 10060629 | A1 | | 6/2002 |
| EP | 0189207 | A2 | | 7/1986 |
| EP | 1510769 | A1 | | 3/2005 |
| GB | 2257267 | A | | 1/1993 |
| JP | 02-126083 | A | | 5/1990 |
| JP | 04-283378 | A | | 10/1992 |
| JP | 05-093567 | A | | 4/1993 |
| JP | 05-099556 | A | | 4/1993 |
| JP | 05-157439 | A | | 6/1993 |
| JP | 10-205951 | A | | 8/1998 |
| JP | 10205951 | A | * | 8/1998 |
| JP | 2002147916 | A | | 5/2002 |
| JP | 2002286343 | A | | 10/2002 |
| WO | 00/17222 | A1 | | 3/2000 |
| WO | 01/48431 | A1 | | 7/2001 |
| WO | 01/70964 | A1 | | 9/2001 |
| WO | 02/089600 | A2 | | 11/2002 |
| WO | 03/089854 | A1 | | 10/2003 |
| WO | 03/089855 | A1 | | 10/2003 |
| WO | 2004/046999 | A2 | | 6/2004 |
| WO | 2004/047000 | A2 | | 6/2004 |
| WO | 2004/047350 | A2 | | 6/2004 |

OTHER PUBLICATIONS

Kommanaboyina, Brahmaiah, et al., "Effects of Temperature Excursions on Mean Kinetic Temperature and Shelf Life", Drug Development and Industrial Pharmacy, vol. 25, No. 12, pp. 1301-1306, Marcel Dekker, Inc., New York, NY, USA (1999).

Lovatt, S.J., et al., "Improved Dynamic Simulation of Multi-Temperature Industrial Refrigeration Systems for Food Chilling, Freezing and Cold Storage", International Journal of Refrigeration, vol. 21, No. 3, pp. 247-260, Elsevier Science Ltd., Oxford, GB (1998).

"Temperature Indicators and Time-Temperature Integrators", International Institute of Refrigeration, Nov. 2004, pp. 1-3, Paris, France.

Akesson, Lina, et al., "Dual Effects of Pituitary Adenylate Cyclase-Activating Polypeptide and Isoproterenol on Lipid Metabolism and Signaling in Primary Rat Adipocytes", Endocrinology, vol. 144, No. 12, pp. 5293-5299 (2003).

* cited by examiner

METHOD FOR CONTROLLING TEMPERATURE IN A REFRIGERATION SYSTEM

CROSS REFERENCE TO RELATED APPLICATIONS

This application is entitled to the benefit of and incorporates by reference essential subject matter disclosed in International Patent Application No. PCT/DK2005/000791 filed on Dec. 14, 2005; and Danish Patent Application No. PA 2004 01949 filed Dec. 16, 2004.

FIELD OF THE INVENTION

The present invention relates to controlling temperature in a refrigeration system in a manner which ensures a better quality of products being refrigerated in the refrigeration system than is the case in prior art control systems. The better quality may, e.g., be in terms of shelf life, appearance or tastiness of the products.

BACKGROUND OF THE INVENTION

Normally the temperature of a refrigeration system is controlled by measuring the temperature of the air being present in or near a display case of the refrigeration system and controlling a flow of refrigerant to an evaporator belonging to that display case in such a way that the air temperature is maintained within a desired temperature range. Thus, in case the air temperature increases above the desired temperature range, e.g. due to an increase in the temperature of the ambient air or a defrost of the evaporator of the display case, this temperature increase will subsequently be compensated by an increase in the flow of refrigerant through the evaporator of the display case. Similarly, a decrease in the air temperature below the desired temperature range will be compensated by a decrease in the flow of refrigerant through the evaporator of the display case.

In order to maintain a high quality for as long as possible the products should be stored at a temperature which is within the desired temperature range. A deviation from this temperature range will result in a faster decay in the quality level of the products. How much faster the decay will be depends on a number of factors, such as the kind of product, how large the deviation is, for how long the temperature deviates, whether the temperature is above or below the preferred temperature range, and the composition and humidity of the ambient air. For example, food which needs to be maintained at a low temperature will decay if the temperature is too high for a period of time, and the higher the temperature and the longer the time period, the faster the quality of the food product will decay. Some products, e.g. most vegetables and some kinds of medicine, will be more or less destroyed if they are subject to temperatures below 0° C. Thus, the quality of such products will decay very rapidly if the temperature drops below 0° C. The quality decay will also depend on the ability of the product to maintain a substantially invariant temperature during a short period of time where the temperature of the surrounding air varies, i.e. it will depend on the thermodynamic properties of the product. Thus, a product having a high thermal capacity, such as a frozen chicken or a carton of milk, will be less affected by a change in the temperature of the surrounding air than a product having a relatively low thermal capacity, such as lettuce or sliced meat.

Due to the many factors mentioned above, controlling the temperature in a refrigeration system purely on the basis of the temperature of the air surrounding the products being refrigerated, i.e. without taking account of special properties of the specific product(s) being refrigerated, will not be sufficient to ensure that a high quality of the product(s) is maintained over the longest possible period of time.

CliniSense Corporation has developed an electronic time-temperature indicator and logger for logging and indicating the quality of a product. The apparatus is positioned next to the product in question and measures the temperature of the surrounding air. Based on the measured temperature and the development of this temperature over time as well as knowledge about various properties of the product, the apparatus performs a stability calculation resulting in a value which is indicative of the present quality of the product. The result of the calculation is displayed on the apparatus. Thus, when a user needs to use the product, he or she can gain information regarding the quality of the product, e.g. in the form of a symbol indicating that the product is fresh or expired, or how much shelf life there is remaining. However, it is not possible to use this information actively so as to prevent or reduce a decrease in quality of the product. A presentation of CliniSense's apparatus can be found on http://www.clinisense.com/eTTI.htm.

It is desirable to be able to control a refrigeration system in such a way that a decrease in quality of products being refrigerated is prevented or at least reduced considerably as compared to known refrigeration systems.

SUMMARY OF THE INVENTION

It is, thus, an object of the present invention to provide a method for controlling a refrigeration system with which the system may be controlled in such a way that a decrease in quality of products being refrigerated is minimised.

It is a further object of the present invention to provide a control system for a refrigeration system being adapted to control the refrigeration system in such a way that a decrease in quality of products being refrigerated is minimised.

Thus, according to a first aspect of the present invention, the above and other objects are fulfilled by providing a method for controlling a temperature in a refrigeration system, the method comprising the steps of:

- obtaining a first temperature value, $T_{Air}$, being indicative of the temperature of the air surrounding one or more products being refrigerated by the refrigeration system,
- processing the first temperature value, $T_{Air}$, using a mathematical model reflecting one or more physical and/or biological processes in the one or more products, where said process(es) may affect the quality of the product(s) during storage, thereby obtaining a quality decay value expressing an expected decay rate in quality of the product(s) in case of continued storage at $T_{Air}$, and
- controlling the temperature in the refrigeration system on the basis of the quality decay value.

According to a second aspect of the present invention, the above and other objects are fulfilled by providing a control system for controlling a temperature in a refrigeration system, the control system comprising:

- means for obtaining a first temperature value, $T_{Air}$, being indicative of the temperature of the air surrounding one or more products being refrigerated,
- means for processing the first temperature value, $T_{Air}$, using a mathematical model reflecting one or more physical and/or biological processes in the one or more products, where said process(es) may affect the quality of the product(s) during storage, thereby obtaining a quality decay value expressing an expected decay rate in quality of the product(s) in case of continued storage at $T_{Air}$, and means for controlling the temperature in the refrigeration system on the basis of the quality decay value.

The control system according to the second aspect of the present invention may advantageously form part of a refrigeration system which further comprises one or more display cases, each being adapted to accommodate one or more products being refrigerated.

It will be clear to a person skilled in the art that features described in connection with the first aspect of the present invention may also be combined with the second aspect of the present invention and vice versa.

In the present context the term 'temperature in a refrigeration system' should be interpreted to mean a temperature which is of importance for the products being refrigerated by the refrigeration system. Thus, it may be a temperature of air being present in one or more display cases of the refrigeration system, or an average of temperatures in various display cases or of temperatures measured at different positions in one display case. Typically, the temperature in the refrigeration system, i.e. the temperature which is controlled, will be $T_{Air}$.

The refrigeration system may be of the kind which is normally present in a supermarket, i.e. comprising one or more display cases, possibly containing various kinds of food products which need to be stored at various temperatures. It may, alternatively, be a refrigeration system being adapted to contain medical products which need to be stored at a very stable temperature.

The products being refrigerated by the refrigeration system may be food products, e.g. fresh food products needing to be stored at a low temperature, such as milk, vegetables, meat, fish, etc. or frozen food products, such as meat, fish, ice cream, ready meals, etc. which need to be stored at a somewhat lower temperature. Alternatively, the products may be other kinds of products which need to be stored at a temperature below room temperature, e.g. certain kinds medicine or wine which should be stored at a 'temperature profile' which varies in a very specific manner over time.

Once the quality decay value has been obtained it is used for controlling the temperature in the refrigeration system. Thus, according to the present invention $T_{Air}$ is obtained, e.g. by measurement, it is subsequently processed, and the processed value is used for controlling a temperature in the refrigeration system. Thereby the temperature in the refrigeration system is controlled while taking possible physical and/or biological processes in the product(s) being refrigerated into consideration, and the temperature control can consequently be customized to minimise the decrease in quality for that/these specific product(s). This is very advantageous. It should be noted that the mathematical model should take the type(s) of product(s) into account, since it must be expected that various product types show different behaviour in terms of quality decay in response to temperature. Thus, the lipid contents, water contents, protein composition, thermodynamic properties, etc. of the product type in question plays an important part in the quality decay and/or quality decay rate of the product.

One example of a physical process which may affect the quality of products during storage is crystallization of ice cream. This may occur if the ice cream is stored above a specific raised temperature level during a certain time period, and the temperature is subsequently lowered to be within an acceptable storage temperature interval.

Examples of biological processes which may affect the quality of products during storage are bacterial growth and protein decomposition.

The quality decay value expresses an expected decay rate in quality of the product(s) in case of continued storage at $T_{Air}$. Thus, the parameter used for controlling the temperature in the refrigeration system reflects how fast the product(s) is/are expected to decay, according to the mathematical model, if nothing is changed. In order to maintain as high a quality as possible for as long a time period as possible, it is desirable to keep the decay rate as close to zero as possible. Thus, if it turns out that the decay rate can be expected to be numerically relatively large if nothing is changed, then the temperature of the refrigeration system should probably be changed.

The control step is preferably performed with due consideration to the energy consumption during refrigeration. Thus, an optimum control strategy is one which balances maintaining as high a quality level for as long as possible against energy consumption, i.e. a reasonable quality decay as well as a reasonable energy consumption is obtained.

Mathematical models for calculating a quality decay of a product being subject to an ambient temperature at specified levels are known per se. An example of such a model is described in B. Kommanaboyina and C. T. Rhodes, 'Effects of Temperature Excursions on Mean Kinetic Temperature and Shelf Life', Drug Development and Industrial Pharmacy, 25(12), 1301-1306 (1999). The mean kinetic temperature is used as a method of quantifying temperatures during transport and storage and consequent possible effects on drug product stability. It is defined as the isothermal temperature that corresponds to the kinetic effects of a time-temperature distribution and is determined using Haynes formula, into which temperature obtained at defined intervals are entered. The MKT equation is:

$$MKT=(\Delta H/R)/\{-\ln[(e^{-\delta H/RT1}+e^{-\delta H/RT2}+\ldots+e^{-\delta H/RTn})n]\},$$

wherein ΔH is the activation energy, R is the universal gas constant T is a measured temperature, and n is the total number of time periods over which data is collected.

Using the calculated MKT it is possible to determine whether or not the product has been adversely affected, e.g. by temperature excursions over a period of time.

Other examples of such models are Time Temperature Indicators or Integrators (TTI) and Hazard Analysis and Critical Control Point (HACCP). These have, e.g., been described by P. S. Taoukis and T. P. Labuza, 'Chemical time-temperature integrators as quality monitors in the chill chain', Proceedings of the International Symposium Quimper Froid '97, Predictive Microbiology of chilled foods, Jun. 16-18, 1998, IIR and European Commission, COST 914. TTI's can be defined as simple, inexpensive devices that can show an easily measurable, time-temperature dependent change that reflects the full or partial temperature history of the food product to which it is attached. The device gives a visual response which gives a cumulative indication on the storage conditions that the TTI has been exposed to. The visual response may be used as an input for calculating the value of a quality factor value, assuming that the quality function is an exponential function of inverse absolute temperature.

As mentioned above, the step of obtaining $T_{Air}$ may comprise measuring a temperature of air present in a display case of the refrigeration system. The temperature of air present in a display case may vary, e.g. from an upper part to a lower part of the display case. Thus, the measured temperature may, e.g., be measured in an upper part of the display case, in a lower part of the display case or in a middle part of the display case. Alternatively, the temperature may be measured just outside the display case, e.g. just above the display case, or the temperature of air circulating around the display case and passing an evaporator may be measured. In case the refrigeration system comprises two or more display cases containing the same kind of products, $T_{Air}$ may be obtained by measuring the temperature of air present in one of these display cases, thereby assuming that the measured temperature is representative for the temperature of air present in any of the display cases.

The mathematical model may further reflect at least a thermodynamic property of one or more product types. The mathematical model may reflect how a specific product is affected if the temperature of the ambient air increases or decreases. Thus, in case of a frozen and relatively bulky product, such as a relatively large piece of meat, e.g. a chicken, the actual temperature of the product will only be affected by a temporary change in the air temperature to a minor extent. On the other hand, the actual temperature of other kinds of products, such as lettuce or sliced meat, will be much more affected by a change in the air temperature. Furthermore, some products may suffer damage or a dramatic decay in the quality if their temperature increases or decreases above/below a certain temperature. An example of this is ice cream which starts crystallizing if its temperature increases above approximately −12° C. Another example is most vegetables, in particular lettuce, which will be very much affected by a decrease in product temperature below 0° C. Such facts may also be taken into consideration in the mathematical model. Since the actual temperature of the product is much more relevant than the temperature of the surrounding air in relation to the quality degradation of the product, this is very important.

In case the one or more products belong to two or more product types, the mathematical model may advantageously be adapted to balance thermodynamic properties of each product type. This may, e.g., be done in such a way that the thermodynamic properties of the most fragile product type, such as the product type which is most sensitive to an increase or decrease in the air temperature, is used for the model. Alternatively, an appropriately weighted average of the thermodynamic properties of all products may be used. The weights may, e.g., reflect the amount of products of each type, such as the number of products or the total weight of the products.

Alternatively, the mathematical model may, for each display case, take into account that the products of the display case have been affected differently. This may, e.g., be done in the following manner. For a specific display case the temperature of the air present in the display case is measured at two outer positions in a transversal direction of the display case. It must be expected that the temperature increases across the display case in a transversal direction due to the fact that heat is transferred from the refrigerated products to the air as the air moves across the display case. On the basis of these two measurements two control parameters are calculated corresponding to products positioned at or near the two outer positions. Over time these calculated control parameters will reflect to what extent the corresponding products have been affected. The mathematical model may then use the control parameter corresponding to the product which has been most affected in a negative manner over a specific time period as an input for the calculation.

The processing step may comprise obtaining a second temperature value, $T_P$, being indicative of the temperature of the one or more products, and $T_P$ may be used for calculating the quality decay value. $T_P$ may advantageously be obtained by means of a thermodynamic model of the products as described above. In this case the quality decay value is calculated on the basis of a parameter which reflects the actual temperature of the individual product, i.e. these properties are taken into account when the quality decay value is calculated.

Models for calculating a product temperature on the basis of a temperature of ambient air are known per se. One example is a thermal model in which the product is regarded as being composed of a number of layers. It is assumed that the thermal boundary conditions at the boundaries between the internal layers can be regarded as first order low pass filters. The exact model depends on thermal properties of the products, such as heat transfer coefficient, relative water content, thermal conductivity, density, etc. Using this model and knowledge of the thermal boundary conditions at the boundary between the outermost layer and the ambient air, the temperature of the product at a certain depth can be calculated based on the ambient temperature. According to this model the product temperature becomes less sensitive to changes in the ambient temperature each time a boundary is crossed. Therefore the product temperature near the middle of the product will be far less sensitive to changes in the ambient temperature than the product temperature at a position which is nearer to the surface of the product.

Furthermore, Linde A G has developed an algorithm for calculating a product temperature from a measured air temperature. The calculated product temperature is subsequently used as an input to the hysteresis control of the display case.

The processing step may be performed while taking expected variations of $T_{Air}$ into account. The occurrence of expected variations may be known well in advance. This is, e.g., the case for scheduled defrosts of at least one display case of the refrigeration system. Alternatively, the expected variations may be of a kind which is not known well in advance, but which may be detected at the onset of the variation or very soon thereafter. As soon as such a variation has been detected, the control system can compensate for the variation. An expected variation of this kind may, e.g., be an increase in the air temperature due to variations in the outdoor temperature, e.g. during the summer. Furthermore, the expected variations may be temporary and/or partial breakdowns requiring maintenance. In this case it may be known that a technician will attend to the problem after a specific time period, e.g. 3 hours. This may subsequently be taken into account when the system is running normally again. A partial breakdown may, e.g., be the breakdown of one or more components of the refrigeration system, such as one or more compressors.

The refrigeration system may comprise at least two display cases. In this case the processing step may be performed while taking expected variations of $T_{Air}$ of each display case into account individually. Thus, the temperature of each display case may be controlled individually with due consideration to the preferred temperature of each display case, the kind of product(s) contained in each display case, etc. Furthermore, the refrigeration system may be controlled as a whole, but while taking the various values of $T_{Air}$ into consideration.

Furthermore, in case the refrigeration system comprises at least two display cases, the control step may comprise prioritising the at least two display cases in case of insufficient refrigeration capacity. Insufficient refrigeration capacity may, e.g., occur in case of a power shortage, in case of unusually high outdoor temperatures, e.g. during a heat wave, or in case of a partial breakdown. In this case it can be very advantageous to be able to prioritise the refrigeration capacity in such a way that display cases containing products which are very vulnerable to temperature variations of the surrounding air, in particular increases in temperature, are given higher priority than display cases comprising products which are not as vulnerable. Thereby it may be ensured that the overall quality degradation of all the products being refrigerated by the refrigeration system is minimised.

Thus, the prioritising may be performed while taking the kind of products present in each display case into account. Alternatively or additionally, the prioritising may be performed while taking properties relating to the display case into consideration. The refrigeration system may, e.g., comprise open display cases as well as closed display cases. The closed display cases will be better at maintaining a low temperature inside the display case in case of an insufficient refrigeration capacity than the open display cases, because the warmer air being present outside the display cases will enter the open display cases much quicker than it will enter the closed display cases. In this case the open display cases may be given a higher priority than the closed display cases.

According to a third aspect of the present invention the above and other objects are fulfilled by providing a method for controlling a temperature in a refrigeration system during a scheduled event, the method comprising the steps of:

obtaining information relating to the scheduled event, processing the obtained information so as to determine one or more expected effects of the scheduled event, and controlling the temperature in the refrigeration system in such a way that the expected effect(s) is/are at least partly compensated prior to the scheduled event.

The scheduled event may advantageously be a scheduled defrost of at least one display case of the refrigeration system. Alternatively or additionally, it may be a scheduled maintenance of one or more display cases, or it may be any other event which may affect the temperature of the refrigeration system, and which can be foreseen and/or scheduled.

The step of obtaining information relating to the scheduled event may comprise obtaining information about the kind of event, time and/or duration of the event, etc. The information may be obtained in a manual manner, e.g. a person entering time and estimated duration of maintenance which is to be performed on one or more display cases. The information may, alternatively or additionally, be obtained from a predefined plan of scheduled defrosts for the display cases of the refrigeration system.

The expected effect(s) of the scheduled event may comprise an increase or a decrease in temperature of air surrounding products being refrigerated in the refrigeration system. In case the scheduled event is a scheduled defrost of a display case, the temperature of air present in that display case must be expected to increase.

The processing step may take various properties, e.g. the ones described in connection with the first and second aspects of the present invention, of the products being refrigerated into account.

The controlling step may comprise lowering the temperature in the refrigeration system prior to a scheduled defrost or a scheduled maintenance, thereby compensating for an expected increase in temperature during the defrost or maintenance. Thereby an increase in product temperature during such an event will be minimised, and a decrease in product quality may be prevented or at least considerably reduced.

It should be understood that features described in relation to the first and second aspects of the present invention can also be combined with the third aspect of the present invention, and vice versa.

BRIEF DESCRIPTION OF THE DRAWINGS

The invention will now be described with reference to the accompanying drawings in which.

DETAILED DESCRIPTION OF THE INVENTION

Figure 1:
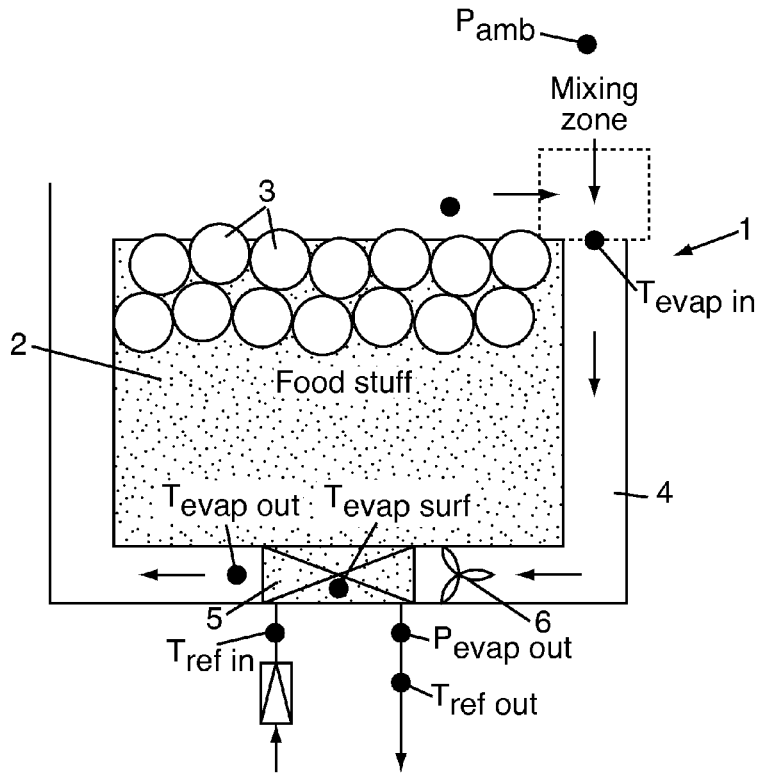
FIG. 1 shows a cross section of a display case of a refrigeration system.

FIG. 1 shows a cross section of a display case 1 of a refrigeration system. The display case 1 comprises a product container 2 containing products 3 being refrigerated by the refrigeration system. The product container 2 is surrounded by an air tunnel 4 for circulating cold air around the product container 2. An evaporator 5 in the air tunnel 4 refrigerates the passing air, thereby creating a curtain of cold air on top of the products 3. The circulation of the air in the air tunnel 4 is ensured by a fan 6, also positioned in the air tunnel 4. The fact that the air curtain is colder than the products 3 and the ambient air enables the desired effect of heat transfer from the curtain to the product container 2 and the products 3, as well as a side effect of ambient air infiltrating into the curtain at the zone above the products 3. This will generate a temperature distribution profile along the direction of air flow as follows. The temperature at the outlet of the evaporator 5 will gradually increase when the air moves along the air tunnel 4 until it reaches a maximum just before reaching the fan 6.

Figure 2:
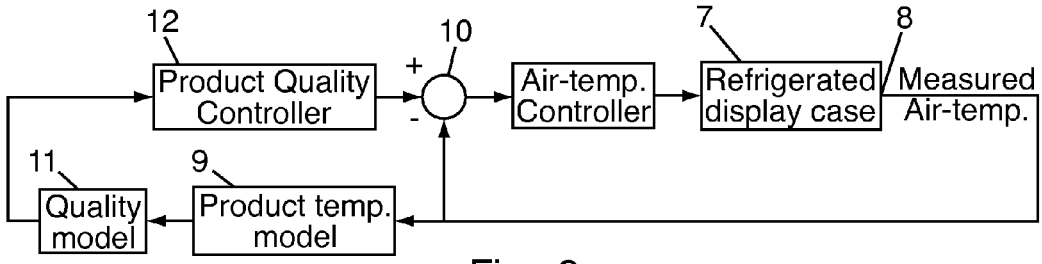
FIG. 2 is a block diagram illustrating a control system according to one embodiment of the present invention.

FIG. 2 is a block diagram illustrating a control system according to an embodiment of the present invention. An air temperature of a refrigerated display case 7 is measured at 8. The refrigerated display case 7 contains one or more products being refrigerated. The products may be just one kind of products, such as only frozen chickens or only dairy products, such as various kinds of milk and yoghurt. Alternatively, the refrigerated display case 7 may contain several kinds of products having slightly different refrigeration needs, such as different kinds of vegetables or fruit or various kinds of meat products. The measured temperature is fed to a product temperature model 9 and to a summing point 10. The summing point 10 will be described in further detail below.

The product temperature model 9 is a mathematical model which takes various properties of the product(s) into account. Such properties may advantageously comprise thermodynamic properties of the product(s). In case there are two or more different types of products present in the refrigerated display case 7, properties relating to each product type may be appropriately weighted and taken into account.

The product temperature model 9 outputs a value which is indicative of a product temperature, i.e. an actual temperature which a product being refrigerated in the refrigerated display case 7 is expected to have, knowing the actual air temperature and the temperature variations over a period of time, and taking the relevant properties of the product(s) into account. This value is fed to a quality model 11, which is also a mathematical model. The quality model 11 calculates a quality decay value which is indicative of an expected decay rate in quality of the product(s), e.g. in terms of shelf life, appearance, tastiness, etc. This quality decay value is calculated on the basis of the calculated product temperature. Alternatively, the product temperature model 9 and the quality model 11 may be replaced by one mathematical model being adapted to calculate a quality decay value directly on the basis of the measured air temperature, i.e. without requiring the separate calculation of the product temperature.

In the embodiment shown in FIG. 2 the quality decay value is fed to a product quality controller 12 being adapted to supply an input to the summing point 10. The input may comprise information regarding the current product quality and whether the quality is likely to decrease and, if so, how rapidly, if the air temperature is not adjusted.

At the summing point 10 the output from the product quality controller 12 is compared to the measured air temperature which has been fed directly to the summing point 10 as described above. This comparison results in a control parameter which is used for controlling the air temperature. In particular, the temperature may be adjusted up or down so as to provide an air temperature which is optimal for the given product(s) under the given circumstances. Thereby a control system has been provided which takes specific properties of the product(s) into account when controlling the air temperature of a refrigeration system. Thus, the temperature may be controlled in such a way that, for each product or product type, the quality degradation can be kept at a minimum.

Figure 3:
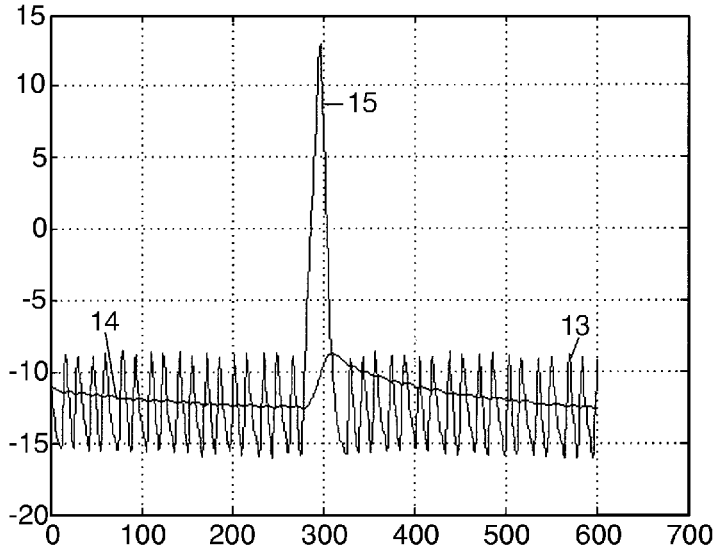
FIG. 3 is a graph showing the air temperature and the product temperature in a prior art refrigeration system during a defrost of the evaporator.

FIG. 3 is a graph showing the air temperature 13 and the product temperature 14 in a prior art refrigeration system during a defrost of the evaporator. The first axis represents time in arbitrary units and the second axis represents temperature in ° C. The defrost of the evaporator is represented by the large spike 15 of the air temperature 13. As can be seen from the figure, the air temperature 13 fluctuates relatively rapidly around a relatively constant mean temperature during normal operation, except during the defrost where the air temperature 13 increases dramatically for a short period of time (as represented by the spike 15).

The product temperature 14 is apparently not influenced by the rapid fluctuations of the air temperature 13, since the product temperature 14 is gradually decreasing during the period preceding the defrost. This indicates that the thermodynamic properties of the product(s) are such that the product (s) is/are able to maintain an obtained temperature, even if the temperature of the surrounding air 13 is temporarily increased. Under these circumstances it must be expected that it will take time to reach a desired (low) product temperature 14 in case the product temperature 14 increases for some reason.

It is clear from the figure that the defrost and the associated dramatic increase in air temperature 13 does affect the product temperature 14. Thus, when the spike 15 appears, the product temperature also starts to increase with a small delay caused by the build-in thermal inertia of the products. After the defrost the air temperature 13 quickly returns to the normal level. However, the increase in product temperature 14 prevails for a longer period of time, resulting in a too high temperature for the product during a time period which is considerably longer than the period of the defrost. This will add considerably to the quality decrease of the product(s).

Figure 4:
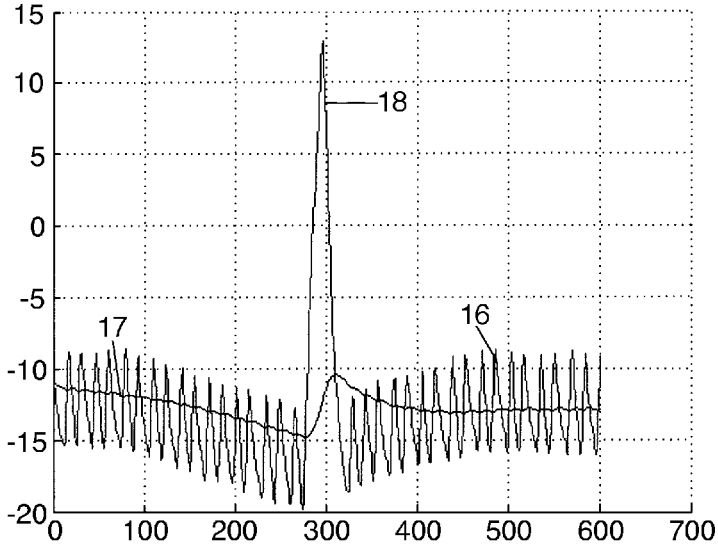
FIG. 4 is a graph showing the air temperature and the product temperature in a refrigeration system according to the present invention during a defrost of the evaporator.

FIG. 4 is a graph showing the air temperature 16 and the product temperature 17 in a refrigeration system according to an embodiment of the present invention during a defrost of the evaporator. As described above, the defrost is represented by a large spike 18 of the air temperature 16. The air temperature 16 and the product temperature 17 will act exactly as described above except for the following. Since a defrost of the evaporator is normally a scheduled act, it can be taken into account when controlling the air temperature 16. Thus, for a period of time before the scheduled defrost, the air temperature 16 is decreased in order to compensate for the known increase in air temperature 16 during the defrost. As a consequence the product temperature 17 is also decreased in the period preceding the defrost. When the product temperature 17 is increased as a consequence of the increase in air temperature 16 during the defrost, the product temperature 17 will not reach as high a level as it would if the air temperature 16 (and consequently the product temperature 17) had not been decreased prior to the defrost. Furthermore, the fact that the air temperature 16 is also kept at a relatively low level after the defrost, ensures that the product temperature 17 is decreased to a desired level relatively quickly. Thereby it is ensured that the quality degradation applied to the product as a consequence of the scheduled defrost is kept as low as possible.

Figure 5:
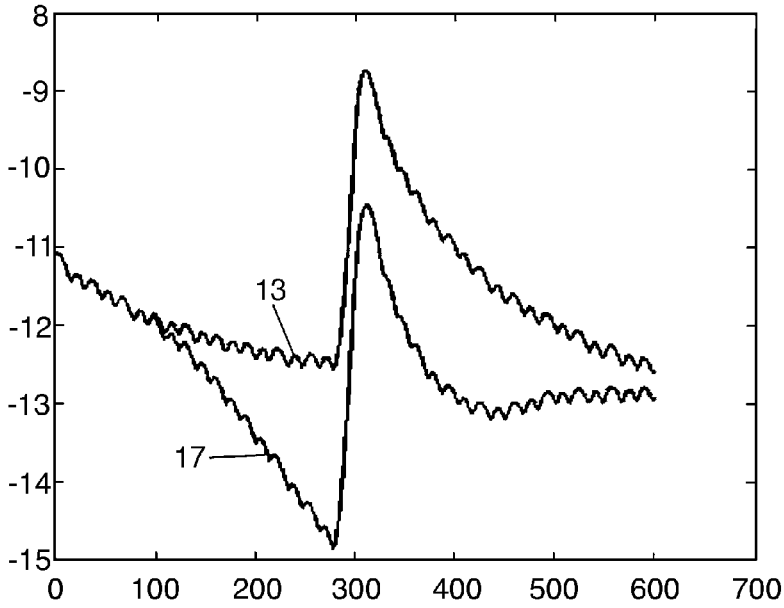
FIG. 5 shows the difference between the product temperature in a prior art refrigeration system and a refrigeration system according to one embodiment of the present invention during a defrost of the evaporator.

FIG. 5 shows the difference between the product temperature 13 in a prior art refrigeration system and the product temperature 17 in a refrigeration system according to the present invention during a defrost of the evaporator. It is clear from the figure that when using the control system according the present invention the product temperature 17 does not reach as high a level and returns to a desired level more rapidly than the product temperature 13 when using a prior art control system. As mentioned above, this has the effect that the quality degradation of the product(s) can be kept at a minimum.

Figure 6:
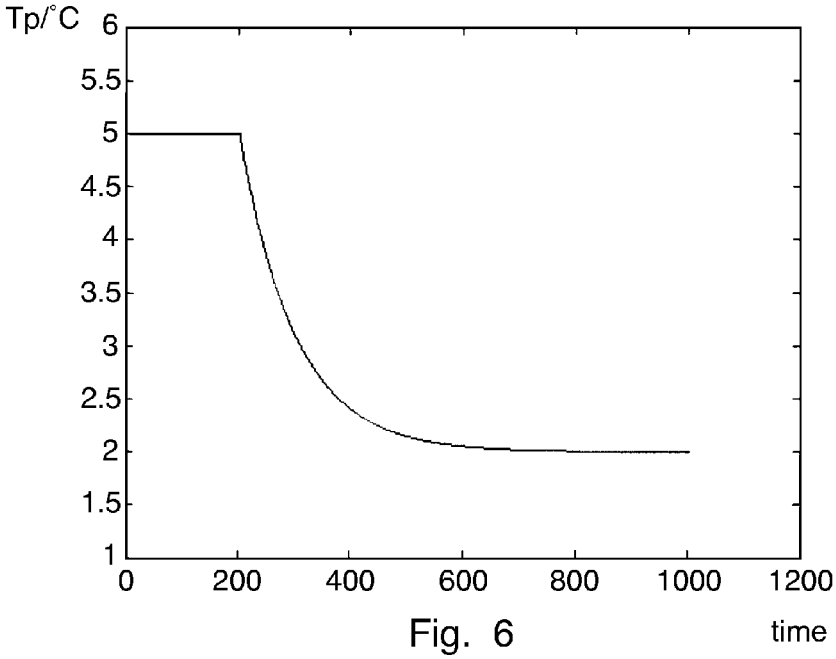
FIG. 6 is a graph illustrating a mathematical model for calculation of the temperature of a product being refrigerated.

FIG. 6 is a graph showing the temperature, $T_P$, of a product being refrigerated as a function of time. The graph in FIG. 6 is calculated on the basis of a mathematical model which will be further described below.

The goal of the model is to obtain an estimate for a temperature which is representative for the actual temperature of the refrigerated product. Assuming that the temperature distribution of the product is at least substantially uniform, the temperature of the product may be modelled using the following formula:

$$\frac{dT_P}{dt} = \frac{1}{m_P C_p}(T_P - T_{air})\alpha A,$$

where $T_P$ is the temperature of the product, $T_{Air}$ is the temperature of the air surrounding the product, $\alpha$ is a heat transfer coefficient, $m_P$ is the mass of the product, $C_p$ is the specific thermal capacity of the product, and A is a contact area between the air and the product.

The heat transfer coefficient depends on the thermal contact between the air and the product. For example, a boxed pizza will have a lower heat transfer coefficient than a pizza which is merely wrapped in a sheet of plastic. This is due to the respective and different insulating properties of the box and the sheet of plastic, i.e. the box will typically provide a better insulation than the sheet of plastic, thereby reducing the thermal contact between the pizza and the surrounding air. The heat transfer coefficient furthermore depends on the air velocity and flow regime, e.g. whether the flow is laminar or turbulent.

The model given above does not take radiation effects into consideration. Thus, it is not included in the model that variations in the temperature of the product, $T_P$, may occur due to heat radiation from the product to, e.g., the ambient air.

Using the formula given above, an estimate for a representative temperature, $T_P$, of the product can be obtained by integrating the formula with respect to time. A result of such an integration is shown in FIG. 6. In this case the following boundary conditions have been used. It is assumed that the temperature, $T_{Air}$, of the surrounding air is kept approximately constant at 2° C. and that the initial temperature of the product is 5° C. Due to the relatively large initial temperature difference between the product and the surrounding air (5° C. and 2° C., respectively), the rate of decrease in $T_P$ is relatively large at the beginning. However, the rate of decrease in $T_P$ becomes smaller as $T_P$ approaches $T_{Air}$ (2° C.). Furthermore, as can be seen from the graph, $T_P$ will gradually approach $T_{Air}$, i.e. the product will eventually obtain the same temperature as the surrounding air.

While the present invention has been illustrated and described with respect to a particular embodiment thereof, it should be appreciated by those of ordinary skill in the art that various modifications to this invention may be made without departing from the spirit and scope of the present invention.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A method for controlling a temperature in a refrigeration system, the method comprising the steps of:

obtaining a first temperature value, $T_{Air}$, being indicative of the temperature of the air surrounding one or more products being refrigerated by the refrigeration system, processing the first temperature value, $T_{Air}$, using a mathematical model based on the product type reflecting, and taking into consideration, one or more physical and/or biological processes in said one or more products, while taking expected variations of the $T_{Air}$ into account, where said process(es) may affect the quality of the product(s) during storage, thereby obtaining a quality decay value expressing an expected decay rate in quality of the product(s) in case of continued storage at $T_{Air}$, and controlling the temperature in the refrigeration system on the basis of the quality decay value.

2. The method according to claim 1, wherein the step of obtaining $T_{Air}$ comprises measuring a temperature of air present in a display case of the refrigeration system.

3. The method according to claim 1, wherein the mathematical model further reflects at least a thermodynamic property of one or more product types.

4. The method according to claim 3, wherein the one or more products belong to two or more product types, and wherein the mathematical model is adapted to balance thermodynamic properties of each product type.

5. The method according to claim 1, wherein the processing step comprises obtaining a second temperature value, $T_P$, being indicative of the temperature of the one or more products, and wherein the quality decay value is obtained on the basis of $T_P$.

6. The method according to claim 1, wherein expected variations of $T_{Air}$ comprises scheduled defrosts of at least one display case of the refrigeration system.

7. The method according to claim 1, wherein the refrigeration system comprises at least two display cases, and wherein the processing step is performed while taking expected variations of $T_{Air}$ of each display case into account individually.

8. The method according to claim 1, wherein the refrigeration system comprises at least two display cases, and wherein the control step comprises prioritizing the at least two display cases in case of insufficient refrigeration capacity.

9. The method according to claim 8, wherein the prioritizing is performed while taking the kind of products present in each display case into account.

10. A control system for controlling a temperature in a refrigeration system, the control system comprising:

means (8) for obtaining a first temperature value, $T_{Air}$, being indicative of the temperature of the air surrounding one or more products being refrigerated, means (9, 11) for processing the first temperature value, $T_{Air}$, using a mathematical model based on the product type reflecting, and taking into consideration, one or more physical and/or biological processes in said one or more products, while taking expected variations of $T_{Air}$ into account, where said process(es) may affect the quality of the product(s) during storage, thereby obtaining a quality decay value expressing an expected decay rate in quality of the product(s) in case of continued storage at $T_{Air}$, and means (12) for controlling the temperature in the refrigeration system on the basis of the quality decay value.

11. A refrigeration system comprising one or more display cases, each being adapted to accommodate one or more products being refrigerated, and a control system according to claim 10.

* * * * *